United States Patent [19]

Kawaski et al.

[11] Patent Number: 4,849,316

[45] Date of Patent: Jul. 18, 1989

[54] HEAT FIXING ELECTROPHOTOGRAPHIC TONER CONTAINING OLEFIN WAX

[75] Inventors: Shoji Kawaski; Hisatomo Sato, both of Yokohama; Masaaki Shin, Fujisawa; Takashi Yamamoto, Mobara, all of Japan

[73] Assignee: Mitsui Toatsu Chemicals, Incorporated, Tokyo, Japan

[21] Appl. No.: 284,851

[22] Filed: Dec. 13, 1988

Related U.S. Application Data

[63] Continuation of Ser. No. 86,785, Aug. 19, 1987, abandoned.

[30] Foreign Application Priority Data

Jul. 10, 1987 [JP] Japan ..... 62-171090

[51] Int. Cl.[4] ..... G03G 9/08; G03G 9/14

[52] U.S. Cl. ..... 435/106.6; 430/110; 430/137; 430/903; 524/487; 524/489; 524/490; 525/197; 525/240

[58] Field of Search ..... 430/110, 137, 106.6, 430/903; 524/487, 489, 490; 525/197, 240; 430/106.6, 903

[56] References Cited

U.S. PATENT DOCUMENTS

| | | | |
|---|---|---|---|
| 3,997,488 | 12/1976 | Tsubuko et al. | 430/137 X |
| 4,153,639 | 5/1979 | Vaughn | 525/197 X |
| 4,535,049 | 8/1985 | Honda et al. | 430/137 |

FOREIGN PATENT DOCUMENTS

| | | | |
|---|---|---|---|
| 57-158848 | 9/1982 | Japan | 430/137 |
| 60-23860 | 2/1985 | Japan | 430/137 |

*Primary Examiner*—Roland E. Martin

*Attorney, Agent, or Firm*—Oblon, Spivak, McClelland, Maier & Neustadt

[57] ABSTRACT

Resin composition containing vinyl polymer and olefin polymer for use in electrophotography, electrostatic recording and electrostatic printing and the like, more particularly the resin composition obtained by uniformly dispersing the olefin polymer in the vinyl polymer, and the toner containing this resin composition are disclosed.

16 Claims, No Drawings

HEAT FIXING ELECTROPHOTOGRAPHIC TONER CONTAINING OLEFIN WAX

This application is a continuation of application Ser. No. 086,785, filed on Aug. 19, 1987, now abandoned.

BACKGROUND OF THE INVENTION

1.Field of the Invention

The present invention relates to a resin composition containing a uniformly dispersed olefin polymer used for electrophotographic toner and also relates to the toner derived from the resin composition. The toner containing the resin composition has a good offset preventing property.

2.Description of the Prior Art

Photoconductive materials are generally applied for electrophotographic methods, to developed electrostatically latent images on a surface of photosensitized body by various means. The latent images are successively developed by electrostatically adhering the toner. The tonered images are transferred onto a copy sheet such as paper etc. and fixed by heat, pressure, solvent vapor or the like to get the duplicate. Various methods and devices have been developed for the fixation step of aforesaid toner images on the copy sheet. Today the most popular method, however, is a thermal press method using hot roller. So the fixing method using hot roller is carried out under heat and pressure that leads to a rapid and effective fixing with excellent thermal efficiency.

But, according to this method, the hot roller surface is brought into contact with toner and melt it, and the melted toner is transferred and print to the copy sheet. Subsequently, there is a problem that the adhered toner residuum on the hot roller transfers on the next copy sheet, which is called as offset problem.

Some methods have been proposed in order to prevent this problem. For example, (1) To increase the melt viscosity of the toner.

(2) To improve the roll release property of the toner, wherein disperse uniformly olefin polymer such as low molecular waxy polypropylene.

Further, method (1) has another weak point of insufficient toner melt and poor toner fixation caused by heat supply shortage accompanying with operation speed up. Notwithstanding an excellent effect being expected by addition of the low molecular weight wax in the method (2), but yet sufficient wax dispersion has not been achieved.

For example, in the wax kneading process to prepare toner (Japanese Patent Publication No. 2304/1977), the variation of particle size distribution in the vinyl polymer and the olefin polymer which are fed to the kneading machine causes errors in the feeding amount due to the maldistribution of the powder, and the differences of dispersed state in the course of time. Besides the low molecular weight polypropylene wax generally has no compatibility with almost all of vinyl polymers such as styrene copolymer resin, normally has a melting point of 100° C. and above, and is difficult to disperse uniformly. Thus the wax has a tendency of disadvantage to require a large quantity for use in toner. Wax rich parts which formed in toner particles by the addition of a large amount of the wax have influence on the electrostatic charge of the toner, and also have a disadvantage that sharp images cannot be obtained. In order to improve the dispersion by the kneading time extension, the resin in the toner is exposed to a high temperature for a longer period and is worsen to cause bad effect contrary.

Besides, in the method of adding the wax in the polymerization of the vinyl monomer, the wax participates the polymerization and has influence on the molecular weight of the resulting resin. The monomer also grafts on the wax and has effect on the glass transition temperature (Tg) of the vinyl polymer. Furthermore, the wax has a disadvantage of reducing the action of roll release agent due to the decomposition of the wax itself.

Therefore, it has been required to establish the technology for uniformly dispersing the wax into the vinyl polymer so that a particle diameter of 0.5–3 μm can be obtained on the wax. Such diameter is sufficient for preventing the offset problem without disadvantageous effect on the toner properties.

BRIEF SUMMARY OF THE INVENTION

The present inventors have investigated these problems. As a result, it has been found that the wax can be uniformly dispersed by removing the solvent after mixing the low molecular weight wax with a solution of the vinyl polymer. Thus the present invention has been completed.

That is, the present invention relates to a resin composition obtained by mixing the low molecular weight wax with a solution of vinyl polymer and successively removing the solvent under reduced pressure in order to provide an uniform dispersion of the wax.

Besides in the present invention, we found that the uniform dispersion of the wax can be achieved by removing the solvent from the solution of vinyl polymer in the presence of the wax, even if a small amount of the wax is added afterwards, additional small amount of the wax can also be incorporated during the preparation of the toner by use of the above-mentioned resin composition. Kneading of the additional wax enables uniform dispersion and prevents the offset problem.

Furthermore, the present inventors have examined methods to achieve a homogeneous dispersion. And the present invention has been succeeded by finding that the state of dispersion can be further improved by dispersing the olefin polymer into the solution of vinyl polymer, heating and flashing into the vacuum system.

That is, the present invention is a resin composition for electrophotographic toner obtained by providing a 50–90 wt./wt. % organic solvent solution containing 100 parts by weight of a vinyl polymer, mixing thereto 0.01–15 parts by weight of an olefin polymer having a number average molecular weight of 1000–50000, and removing the solvent from the resulting mixture under an absolute pressure of 0–200 mmHg; and a toner containing the resin composition.

DETAILED DESCRIPTION OF THE INVENTION AND PREFERRED EMBODIMENTS

The vinyl polymers which could be used in the present invention include, for example, homopolymers and copolymers of acrylic esters such as methyl acrylate, ethyl acrylate, propyl acrylate, butyl acrylate, octyl acrylate, cyclohexyl acrylate, dodecyl acrylate, stearyl acrylate, benzyl acrylate, furfuryl acrylate, tetrahydrofurfuryl acrylate, hydroxyethyl acrylate, hydroxybutyl acrylate etc.; methacrylic esters such as methyl methacrylate, ethyl methacrylate, propyl methacrylate, butyl methacrylate, octyl methacrylate, dodecyl methacrylate, stearyl methacrylate, cyclohexyl methacrylate, benzyl methacrylate, furfuryl methacrylate, tetrahydrofurfuryl methacrylate, hydroxyethyl methacrylate, hydroxypropyl methacrylate, hydroxybutyl methacrylate etc.; aromatic vinyl monomers such as styrene, vinyl toluene, α-methyl styrene, chlorostyrene etc.; unsaturated dibasic acid dialkyl esters such as dibutyl maleate, dioctyl maleate, dibutyl fumarate, dioctyl fumarate etc.; vinyl esters such as vinyl acetate, vinyl propionate etc.; nitrogen containing vinyl monomers such as acryl nitrile, methacryl nitrile, methacryl amide, acryl amide etc.; unsaturated carboxylic acids such as acrylic acid, methacrylic acid, cinnamic acid etc.; unsaturated dicarboxylic acids such as maleic acid, maleic anhydride, fumaric acid, itaconic acid etc.; and unsaturated dicarboxylic acid monoesters such as monomethyl maleate, monoethyl maleate, monobutyl maleate, monoctyl maleate, monomethyl fumarate, monoethyl fumarate, monobutyl fumarate, monoctyl fumarate etc.

These vinyl polymers may be used alone or in combination of two and more.

The styrene-acryl resin which is employed as the vinyl polymer in this invention is a copolymer obtained by polymerizing styrene as a primary monomer with other vinyl monomers. The other vinyl monomers referred to the aforesaid each monomer.

The vinyl polymer has a weight average molecular weight of normally 10,000–500,000.

The organic solvent solution of the vinyl polymer is a solution of the above described resin in the following solvents. The solvents which could be used include, for example, hydrocarbon solvents such as benzene, toluene, xylene, solvent naphthas of grade No. 1, 2 and 3, cyclohexane, ethylbenzene, Solvesso 100 TM, Solvesso 150 TM, mineral spirit etc.; alcohol solvents such as n-butyl alcohol, sec-butyl alcohol, i-butyl alcohol, amyl alcohol, cyclohexanol etc.; ketone solvents such as acetone, methyl ethyl ketone, methyl isobutyl ketone, cyclohexanone, etc.; ester solvents such as ethyl acetate, n-butyl acetate, ethoxyethyl acetate etc.; ether solvents such as methoxyethanol ethoxyethanol, butoxyethanol, diethylene glycol monomethyl ether etc.; and the like. Aromatic, ketone and ester solvents are preferred among these solvents. These solvents could also be used in combination of two or more.

The vinyl polymer solution could be prepared by solution polymerization. The solution may also be provided by dissolving the resin in the aforesaid solvents after preparing the resin by bulk polymerization, suspension polymerization or bulk/suspension polymerization. In view of operation and dispersion efficiency, the concentration of the vinyl polymer solution is normally 5–90 wt. % and preferably 30–70 wt. %.

The olefin polymer in this invention also refers to low molecular weight wax in the present specification. The olefin polymer is polyolefin having a relatively low melting point and a number average molecular weight of approximately 1,000–50,000, and preferably having a number average molecular weight of about 2,000–10,000. The polyolefin has a softening point of preferably 100°–180° C., and more preferably 130°–160° C.

Examples of such polyolefin include, polyethylene, polypropylene, polybutylene etc. and additionally include modified products obtained by the oxidation of these polyolefins. Polypropylene is particularly preferable among these polyolefins.

The term removing the solvent under reduced pressure in this invention refers to the step of removing the solvent from the above-mentioned vinyl polymer at a temperature of 120°–250° C. under an absolute pressure of 0–200 mmHg. In order to particularly inhibit thermal deterioration of the vinyl polymer or the low molecular weight wax and to remove the solvent sufficiently, the solvent removing process is preferably carried out at a temperature of 150°–220° C. under reduced pressure. Among the several means for removing the solvent, flashing is an effective means in particular.

Any amount of the low molecular weight wax can be added in the solvent removing state to the vinyl polymer solution of this invention. The amount is normally in the range of 0.01–15 parts by weight per 100 parts by weight of the solid matter in the polymer solution. When the wax is present in the solvent removing stage, the wax uniformly disperses in the polymer without phase separation between the polymer and the wax. Therefore the resin composition thus obtained can easily and uniformly disperse the additional wax which is afterwards kneaded therein, even though a small amount of the wax is present in the solvent removing stage.

Since the wax can be uniformly dispersed in particular, the amount of wax in the toner composition is smaller than that of conventional compositions, while capable of sufficiently providing the offset preventing ability to the toner. Although any level is permitted, the wax content in toner is normally 1–20 wt. % in total amount.

The mixing and dispersion of the olefin polymer in the vinyl polymer solution is conducted by adding 0.01–15 parts by weight of the olefin polymer to 100 parts by weight of the vinyl polymer and followed by stirring the mixture. Batch process or continuous process may be employed, either.

In the next step, the mixture obtained by dispersing the olefin polymer into the vinyl polymer solution is heated to a temperature of 120°–250° C., preferably 150°–220° C. There is no problem on applying pressure to prevent solvent evaporation during this heating.

After heating the mixture, it is flashed into the vacuum system. The system is evacuated to an absolute pressure of preferably 0–200 mmHg and more preferably 0–50 mmHg.

In the resin composition wherein the olefin polymer is mixed and dispersed, the olefin polymer is generally in a solid state at a temperature of 100° C. or less and forms a solid/liquid dispersion system. As the dispersion system is heated to 120°–150° C., the olefin polymer melts and substantially forms a liquid/liquid dispersion system wherein the olefin polymer exists as oil droplets.

In the vacuum flashing step of the vinyl polymer solution which was previously mixed and dispersed with the olefin polymer, the pressure is reduced to the vapor pressure of the solution or less at the temperature of the solution. By pressure reduction, the solution swell out its volume and generates foams accompanying by evaporation of the solvent from the solution. During the expansion the oily droplets of the olefin polymer are further divided into a finer dispersion by the force of foaming. The particle size of the olefin polymer is reduced by a factor of 0.2–0.05 and exhibits an excellent dispersing effect.

During this process, the absolute pressure must always be maintained in the range of 0–200 mmHg by adjusting pumps etc. Besides the vacuum chamber is preferably heated during the vacuum flashing step so as to compensate heat loss corresponding to the latent heat of evaporation caused by removing the solvent.

The resin composition using for the toner prepared by the aforementioned preparation method has an excellent dispersion of the olefin polymer. In addition, the exposing time to the high temperature is very short as compared with conventional methods. Thus the thermal degradation of olefin polymer and vinyl polymer is avoided and resulted the improvement of toner quality. The dispersed olefin polymer has a particle size of 0.05–3 μm in the vinyl polymer, and the state of dispersion has been much improved as compared with former.

The toner of the present invention also has the good properties with respect to developing, transfer, cleaning, pulverization, electrostatic stability and the like.

In the toner preparation step, the aforesaid resin obtained by removing the solvent is ground by conventional methods. The powder obtained thus is mixed with various coloring agents represented by carbon black and optionally charge control agents, for example, nigrosine, metal containing azo dyestuffs etc., in order to control triboelectric charge. In case of the too small amount of the low molecular weight wax was incorporated before removing the solvent, the desired amount of the wax may be further added in this stage to prevent the offset problem. In addition, magnetic iron oxides, reduced iron powder etc. may also be added in order to prepare magnetic toner. The resulting mixture is then kneaded, ground and sized to prepare the toner. Other types of resin component may also be added in the range not to fail the effect of this invention. The amount of the resin in toner is not more than 30–95 parts by weight per 100 parts by weight of the toner.

The toner obtained by the present invention contains the low molecular weight wax homogeneously dispersed therein. Therefore, the toner can avoid the offset problem using smaller quantity of the employed wax. The smaller quantity also leads to improve other qualities of the toner.

EXAMPLES

The present invention will be hereinafter described in detail with respect to the examples which do not restrict the scope of this invention. The term "parts" represents parts by weight.

Besides the molecular weight determination of the resin was conducted in accordance with GPC method. Following equipment and measuring conditions were used.

Detector: SHODEX Rl SE-31
Column: A-80M x 2 +KF-802
Solvent: THF (tetrahydrofuran)
Flow rate: 1.2 ml/min.
Sample: 0.25% THF Solution

Resin Composition Preparation Example 1

A 5, four necked flask equipped with a cooler, thermometer, nitrogen inlet tube and stirrer was charged with 70 parts of styrene and 30 parts of n-butyl methacrylate. Bulk polymerization was carried out at 100° C. under introduction of nitrogen. When the conversion reached to 80%, 50 parts of xylene, 45 parts of styrene and 5 parts of n-butyl methacrylate were added into the flask, uniformly mixed and discharged.

The same polymerization vessel as above was charged with 150 parts of xylene. The polymerization was carried out under reflux by adding dropwise a mixture of 150 parts of above obtained resin-monomer solution and 10 parts of azobisisobutyronitrile over 4 hours by using a continuous dropping device. The vinyl resin X thus obtained in a solution had a weight average molecular weight of $2.3\times10^4$ and a Tg of 62° C.

In the next method, the same vessel as above was charged with 70 parts of styrene, 30 parts of nbutyl metacrylate and 5 parts of low molecular weight polypropylene wax (number average molecular weight 4000). Bulk polymerization and solution polymerization were conducted by the same method as X to obtain a solution of vinyl resin Y having a weight average molecular weight of $2.2\times10^4$ and a Tg of 59° C.

In the other method, the same vessel as above was used, bulk polymerization was carried out by using the same monomer composition, and the same amount of xylene, styrene and n-butyl methacrylate were added. Into the xylene to be used for the solution polymerization, 5 parts of the low molecular weight wax (M.W. 4000) were charged and solution polymerization was conducted by the same method as X to obtain a solution of vinyl resin Z having a weight average molecular weight of $2.0\times10^4$ and a Tg of 58° C.

Unless otherwise noted, the resin prepared by the above methods can be subjected to removing the solvent at 200° C. under pressure of 20 mmHg to obtain the resin compositions for the toner.

Comparative Examples 1–6 with Respect to Solvent Removal

The resin solutions X, Y and Z prepared in Preparation Example 1 were subjected to removing the solvent under conditions illustrated in Table 1 without further addition of the wax.

With 100 parts of the resin thus obtained, 5 parts of carbon black as a colorant, 1 part of charge control agents and low molecular weight polypropylene wax (M.W. 4000) in an amount shown in Table 1 were mixed. The mixture was kneaded at 120° C. for 30 minutes and ground to obtain coarse particles of the toner having a particle size of approximately 2 mm. The coarse particles were finely pulverized with a jet mill (a product from Japan Pneumatic Co.), and then classified to obtain toner particles having a particle size of approximately 10 μm.

The toner thus obtained was evaluated by using a copying machine and the evaluation results are illustrated in Table 1.

TABLE 1

| | | Solvent Removal | | Wax[1] Addition | Evaluation Results | | |
|---|---|---|---|---|---|---|---|
| Comparative Example | Resin Solution | Wax Addition (part) | Temperature (°C.) | in Kneader (part) | Blocking at 50° C. | Offset Initiation Temperature (°C.) | Copy Image |
| 1 | X | O | 200 | 1 | ○ | 170 | Somewhat good |
| 2 | X | O | 200 | 3 | ○ | 180 | Somewhat good |

TABLE 1-continued

| Comparative Example | Resin Solution | Solvent Removal: Wax Addition (part) | Solvent Removal: Temperature (°C.) | Wax[1] Addition in Kneader (part) | Evaluation Results: Blocking at 50° C. | Evaluation Results: Offset Initiation Temperature (°C.) | Evaluation Results: Copy Image |
|---|---|---|---|---|---|---|---|
| 3 | X | O | 200 | 5 | ○ | 195 | Somewhat good |
| 4 | Y | O | 200 | 0 | X | 170 | Somewhat good |
| 5 | Z | O | 200 | 0 | X | 165 | poor |
| 6 | X | O | 200 | 10 | ○ | 210 | poor |

Note:
[1]Added amount of wax is parts per 100 parts of solid matter in the resin solution.

Methods of evaluation are as follows:

Blocking Property:

Toner particles (10 g) are stored in a constant temperature chamber at 50° C. for 24 hours, cooled to the room temperature and blocking is evaluated by visual inspection ○ : No blocking is found.

Δ: Blocking is found, but can be got out of shape easily.

X Firm blocking is found.

Copy Image:

Sharpness of the 10,000 the copy is evaluated by visual inspection.

Offset Initiation Temperature:

Copy is made by each 10° C. increase in the hot roll temperature of the copying machine (Mita Industrial Co., Ltd.) which is reconstructed enable to change the operating temperature. The existence of offset is judged by visual inspection. The temperature at which the first generation of offset is observed is defined as offset initiation temperature. Higher initiation temperature indicates better offset property.

As clearly shown in Table 1, the offset preventing property was still insufficient in Comparative Examples 1 -3 wherein the resin solution X was used. When 10 parts of the wax were used as illustrated in Comparative Example 6, the offset preventing property was satisfactory and yet wax rich parts were generated and caused a problem of somewhat poor images. Besides addition of the wax during the polymerization caused problems in offset prevention, blocking and images as shown in Comparative Examples 4 and 5.

Examples 1-12

To 100 parts of the solid component in the resin solution X, low molecular weight polypropylene wax (M.W. 4000) was added in an amount illustrated in Table 2, mixed and the solvent was removed to obtain the resin composition for toner.

The formulation for preparing the toner and the method for evaluation were the same as in Comparative Example 1. The results are illustrated in Table 2.

As illustrated in Table 2, addition of the wax in the solvent removing step even in an amount of 0.01 part improves the offset preventing property better than Comparative Examples 1-3. However, it is more desirable to add at least 0.05 part of the wax.

TABLE 2

| Example | Solvent Removal: Wax Addition (part) | Solvent Removal: Temperature (°C.) | Wax Addition in Kneader (part) | Evaluation Results: Blocking | Evaluation Results: Offset Initiation Temperature (°C.) | Evaluation Results: Copy Image |
|---|---|---|---|---|---|---|
| 1 | 0.01 | 200 | 2.99 | ○ | 200 | Nearly Good |
| 2 | 0.05 | 200 | 2.95 | ○ | 205 | Good |
| 3 | 0.5 | 200 | 2.50 | ○ | 210 | Good |
| 4 | 1 | 200 | 2 | ○ | 210 | Good |
| 5 | 3 | 200 | 0 | ○ | 210 | Good |
| 6 | 5 | 200 | 0 | ○ | 210 | Good |
| 7 | 6 | 200 | 0 | ○ | 210 | Nearly Good |
| 8 | 0.01 | 200 | 4.99 | ○ | 200 | Good |
| 9 | 0.05 | 200 | 4.95 | ○ | 210 | Good |
| 10 | 0.5 | 200 | 4.5 | ○ | 210 | Good |
| 11 | 1 | 200 | 4 | ○ | 210 | Good |
| 12 | 3 | 200 | 2 | ○ | 210 | Good |

Examples 14 -17 and Reference Examples 13 and 18

The same procedures as described in Example 1, were carried out by using the resin solution X and the solvent removing temperature illustrated in Table 3 to obtain the resin compositions for toner.

The toner formulation and the method of evaluation were the same as described in Comparative Example 1. The results obtained are illustrated in Table 3.

As illustrated in Table 3, the toner could obtain almost satisfied properties by use of the resin prepared by removing the solvent at 120°-250° C. It is particularly desirable to use the resin prepared by removing the solvent at 150°-220° C.

TABLE 3

| | Solvent Removal | | Wax Addition in Kneader (part) | Evaluation Results | | |
|---|---|---|---|---|---|---|
| | Wax Addition (part) | Temperature (°C.) | | Blocking | Offset Initiation Temperature (°C.) | Copy Image |
| Reference Example 13 | 3 | 100 | 2 | Δ | 180 | Somewhat Poor |
| Example 14 | 3 | 120 | 2 | ○ | 200 | Nearly Good |
| Example 15 | 3 | 150 | 2 | ○ | 210 | Good |
| Example 16 | 3 | 220 | 2 | ○ | 210 | Good |
| Example 17 | 3 | 250 | 2 | Δ | 205 | Good |
| Reference Example 18 | 3 | 260 | 2 | Δ | 200 | Nearly Good |

EXAMPLE 18

Bulk polymerization was carried out at 120° C. by using 70 parts of styrene and 30 parts of butyl acrylate. The polymerization was proceeded until 60% of these vinyl monomers had polymerized, and then 50 parts of xylene were added. The resulting solution was added with 0.2 part of azobisisobutyronitrile as a polymerization initiator and conducted solution polymerization at 100° C to complete the reaction.

Separately 100 parts of xylene were refluxed and continuously added dropwise with 80 parts of styrene, 20 parts of butyl acrylate and 3 parts of a initial to conduct polymerization. The former and the latter solutions thus obtained were mixed in a resin ratio of 2:1.

The resulting mixture was added with 1 part of low molecular weight polypropylene wax (M.W. 4000) per 100 parts of the resin contained in the mixture to carry out preliminary dispersion. The resin solution obtained was passed through a heat exchanger at a constant feed rate, heated to 180° C, and flashed into a vacuum chamber having an absolute pressure of 15 mmHg. Xylene in the solution was evaporated and the resin was precipitated on the bottom of the vacuum chamber. In this step, a violent foaming was generated and the low molecular weight wax was finely dispersed in the vinyl polymer. The resin precipitated on the bottom of the vacuum chamber was cooled, solidified, ground, and followed by dissolving in tetrahydrofuran to measure the particle size of the low molecular weight wax. The particle size was 2 μm.

Example 19

Bulk polymerization was carried out at 90° C. by using 60 parts of styrene, 20 parts of butyl methacrylate and 0.2 part of a initiator. The polymerization was proceeded until 40% of these vinyl monomers had polymerized, and then 60 parts of ethylbenzene were added. The resulting solution was added with 0.2 part of dibutyl peroxide as a polymerization initiator and conducted solution polymerization at 135° C. to complete the reaction.

Separately 100 parts of ethylbenzene were heated to 120° C. and continuously added dropwise with 60 parts of styrene, 40 parts of methyl methacrylate and 6 parts of a initiator to conduct polymerization. The former and the latter solutions thus obtained were mixed in a resin ratio of 1:1.

The resulting mixture was added with 1.5 parts of low molecular weight polypropylene wax (M.W. 4000) per 100 parts of the resin contained in the mixture to carry out preliminary dispersion. The resin solution obtained was passed through a heat exchanger at a constant feed rate, heated to 200° C., and flashed into a vacuum chamber having an absolute pressure of 20 mmHg. Ethyl benzene in the solution was evaporated and the resin was precipitated on the bottom of the vacuum chamber. In this step, a violent foaming was generated and the low molecular weight wax was finely dispersed in the vinyl polymer. The resin precipitated on the bottom of the vacuum chamber was cooled, solidified, ground, and followed by dissolving in tetrahydrofuran to measure the particle size of the low molecular weight wax. The particle size was 1.5 μm.

Example 20

Bulk polymerization was carried out at 125° C. by using 70 parts of styrene, 25 parts of 2-ethylhexyl acrylate and 5 parts of methacrylic acid. The polymerization was proceeded until 50% of these vinyl monomers had polymerized, and then 40 parts of ethyl acetate were added. The resulting solution was added with 0.2 part of azobisisobutyronitrile as a polymerization initiator and conducted solution polymerization at 70° C. to complete the reaction.

Separately 100 parts of ethyl acetate were refluxed and continuously added dropwise with 80 parts of methyl methacrylate, 15 parts of butyl acrylate, 5 parts of methacrylic acid and 3 parts of a catalyst to conduct polymerization. The former and the latter solutions thus obtained were mixed in a resin ratio of 1.5:1.

The resulting mixture was added with 4 parts of low molecular weight polyethylene wax (M.W. 4000) per 100 parts of the resin contained in the mixture to carry out preliminary dispersion. The resin solution obtained was passed through a heat exchanger at a constant feed rate, heated to 160° C., and flashed into a vacuum chamber having an absolute pressure of 10 mmHg. Ethyl acetate in the solution was evaporated and the resin was precipitated on the bottom of the vacuum chamber. In this step, a violent foaming was generated and the low molecular weight wax was finely dispersed in the vinyl polymer. The resin precipitated on the bottom of the vacuum chamber was cooled, solidified, ground and followed by dissolving in tetrahydrofuran to measure the particle size of the low molecular weight wax. The particle size was 2 μm.

Example 21

Bulk polymerization was carried out at 90° C. by using 70 parts of methyl methacrylate, 30 parts of butyl acrylate and 0.1 part of a initiator. The polymerization was proceeded until 60% of these vinyl monomers had polymerized, and then 50 parts of toluene were added.

The resulting solution was added with 0.2 part of perbutyl octoate as a polymerization initiator and conducted solution polymerization at 90° C. to complete the reaction.

Separately 100 parts of toluene were refluxed and continuously added dropwise with 80 parts of styrene, 20 parts of isobutyl methacrylate and 3 parts of a initiator to conduct polymerization. The former and the latter solutions thus obtained were mixed in a resin ratio of 2:1.

The resulting mixture was added with 10 parts of low molecular weight polypropylene wax (M.W. 4000) per 100 parts of the resin contained in the mixture to carry out preliminary dispersion. The resin solution obtained was passed through a heat exchanger at a constant feed rate, heated to 180° C. and flashed into a vacuum chamber having an absolute pressure of 12 mmHg. Xylene in the solution was evaporated and the resin was precipitated on the bottom of the vacuum chamber. In this step a violent foaming was generated and the low molecular weight wax was finely dispersed in the vinyl polymer.

The resin precipitated on the bottom of the vacuum chamber was cooled, solidified, ground and followed by dissolving in tetrahydrofuran to measure the particle size of the low molecular weight wax. The particle size was 1.7 μm.

Example 22

Bulk polymerization was carried out at 120° C. by using 60 parts of styrene, 20 parts of 2-ethylhexyl acrylate and 20 parts of butyl methacrylate. The polymerization was proceeded until 40% of these vinyl monomers had polymerized, and then residual monomer was removed. The resulting resin was dissolved in 100 parts of Solvesso TM 100.

Separately 100 parts of Solvesso TM 100 were heated to 150° C. and continuously added dropwise with 80 parts of styrene, 20 parts of butyl acrylate and 3 parts of a initiator to conduct polymerization. The former and the latter solutions thus obtained were mixed in a resin ratio of 1:2.

The resulting mixture was added with 10 parts of low molecular weight polypropylene wax (M.W. 4000) per 100 parts of the resin contained in the mixture to carry out preliminary dispersion. The resin solution obtained was passed through a heat exchanger at a constant feed rate, heated to 220° C. and flashed into a vacuum chamber having an absolute pressure of 10 mmHg. Solvesso TM 100 in the solution was evaporated and the resin was precipitated on the bottom of the vacuum chamber. In this step, a violent foaming was generated and the low molecular weight wax was finely dispersed in the vinyl polymer.

The resin precipitated on the bottom of the vacuum chamber was cooled, solidified, ground and followed by dissolving in tetrahydrofuran to measure the particle size of the low molecular weight wax. The particle size was 1 μm.

Example 23

Bulk polymerization was carried out at 120° C. by using 60 parts of styrene, 20 parts of butyl acrylate and 20 parts of methyl methacrylate.

The polymerization was proceeded until 40% of these vinyl monomers had polymerized. The polymerized solution was added with 100 parts of water and 0.5 part of a initiator and conducted suspension polymerization at 80° C. After completing the reaction, the resulting resin was washed and dried. After dissolving 100 parts of the resin thus obtained in a mixture of 50 parts of xylene and 50 parts of ethylbenzene, 3 parts of low molecular weight polypropylene wax (M.W. 4000) were added to carry out preliminary dispersion. The resin solution obtained was passed through a heat exchanger at a constant feed rate, heated to 210° C. and flashed into a vacuum chamber having an absolute pressure of 15 mmHg. Xylene and ethylbenzene in the solution were evaporated and the resin was precipitated on the bottom of the vacuum chamber. In this step, a violent foaming was generated and the low molecular weight polypropylene wax was finely dispersed in the vinyl polymer. The resin precipitated on the bottom of the vacuum chamber was cooled, solidified, ground and followed by dissolving in tetrahydrofuran to measure the particle size of the low molecular weight polypropylene wax. The particle size was 2 μm.

Example 24

Bulk polymerization was carried out at 80° C. by using 70 parts of styrene, 30 parts of 2-ethylhexyl acrylate and 1 part of a initiator.

The polymerization was proceeded until 45% of these vinyl monomers had polymerized, and then 60 parts of ethylbenzene were added. The resulting solution was added with 0.2 part of azobisisobutyronitrile as a polymerization initiator and conducted solution polymerization at 100° C. to complete the reaction.

Separately 100 parts of ethylbenzene were refluxed and continuously added dropwise with 80 parts of methyl methacrylate, 20 parts of butyl acrylate and 3 parts of a initiator to conduct polymerization. The former and the latter solutions thus obtained were mixed in a resin ratio of 1:1.

The resulting mixture was added with 3 parts of low molecular weight polypropylene wax (M.W. 4000) to carry out preliminary dispersion. In order to remove ethylbenzene from the resin solution, the reaction vessel was gradually heated. After recovering ethylbenzene under atmospheric pressure, the system was gradually evacuated to an absolute pressure of 12 mmHg in order to remove residual ethylbenzene. Then the reaction vessel was further stirred for an hour to disperse the low molecular weight polypropylene wax. The product was discharged from the reaction vessel, cooled, solidified and ground. The resin thus obtained was dissolved in tetrahydrofuran to measure the particle size of the low molecular weight wax. The particle size was 8 μm.

Comparative Example 7

Bulk polymerization was carried out at 90° C. by using 70 parts of styrene, 30 parts of butyl methacrylate and 3 part of a initiator. The polymerization was proceeded until 60% of these vinyl monomers had polymerized, and then 50 parts of toluene were added. The resulting solution was added with 0.2 part of azobisisobutyronitrile as a polymerization initiator and conducted solution polymerization at 100° C. to complete the reaction.

Separately 100 parts of toluene were refluxed and continuously added dropwise with 80 parts of styrene, 20 parts of butyl acrylate and 3 parts of a initiator to conduct polymerization. The former and the latter solutions thus obtained were mixed in a resin ratio of 3:2.

The resulting mixture was added with 1 part of low molecular weight polypropylene wax (M.W. 4000) per 100 parts of the resin contained in the mixture to carry out preliminary dispersion. The resin solution obtained was passed through a heat exchanger at a constant feed rate, heated to 110° C. and flashed into a vacuum chamber having an absolute pressure of 400 mmHg. Toluene in the solution was evaporated and the resin was precipitated on the bottom of the vacuum chamber.

The resin precipitated on the bottom of the vacuum chamber was cooled and solidified. Toluene, however, remained in the resin and solvent removal was unsatisfactory. The resin was dissolved in tetrahydrofuran and particle size of the low molecular weight wax was measured. The particle size was 7 μm and the dispersion of the low molecular weight polypropylene wax was found to be insufficient.

Comparative Example 8

Bulk polymerization was carried out at 120° C. by using 70 parts of styrene and 30 parts of butyl acrylate. The polymerization was proceeded until 60% of these vinyl monomers had polymerized, and then 50 parts of xylene were added. The resulting solution was added with 0.2 part of azobisisobutyronitrile as a polymerization initiator and conducted solution polymerization at 100° C. to complete the reaction.

Separately 100 parts of xylene were refluxed and continuously added dropwise 80 parts of styrene, 20 parts of methyl methacrylate and 6 parts of a initiator to conduct polymerization.

The former and the latter solutions thus obtained were mixed in a resin ratio of 2:1. The resulting resin solution was passed through a heat exchanger at a constant feed rate, heated to 180° C. and flashed into a vacuum chamber having an absolute pressure of 15 mmHg. Xylene in the solution was evaporated and the resin was precipitated on the bottom of the vacuum chamber. The resin precipitated on the bottom of the vacuum chamber was cooled, solidified and successively ground.

By using a kneader, 100 parts of the resin thus obtained and 1 part of the low molecular weight polypropylene wax (M.W. 4000) were kneaded at 150° C. for 30 minutes and ground to obtain a resin composition for toner. The resin composition was dissolved in tetrahydrofuran. The particle size of insoluble low molecular weight wax was measured under a microscope to give a size of 6 μm.

Using the resin composition for toner prepared in Examples 18 -24 and Comparative Examples 7 and 8, 100 parts of the resin composition were mixed with 5 parts of carbon black and 1 part of a charge adjusting agent, kneaded at 140° C. for 30 minutes with a kneader and ground to obtain coarse particles of the toner having a particle size of about 2 mm.

The coarse particles were finely pulverized with a jet mill (a product from Japan Pneumatic Co.), and then classified to obtain toner particles having a particle size of approximately 10 μm.

The toner thus obtained was evaluated by using a copying machine and the evaluation results are illustrated in Table 4.

TABLE 4

| Resin Composition for Toner | Particle Size of Wax (μ) | Blocking (50° C.) | Offset Initiation Temperature (°C.) | Copy Image |
|---|---|---|---|---|
| Example 18 | 2 | O | 220< | good |
| Example 19 | 1.5 | O | 220< | good |
| Example 20 | 2 | O | 220< | good |

TABLE 4-continued

| Resin Composition for Toner | Particle Size of Wax (μ) | Blocking (50° C.) | Offset Initiation Temperature (°C.) | Copy Image |
|---|---|---|---|---|
| Example 21 | 1.7 | O | 220< | good |
| Example 22 | 1 | O | 220< | good |
| Example 23 | 2 | O | 220< | good |
| Example 24 | 8 | O | 205 | somewhat good |
| Comparative Example 7 | 7 | X | 150< | poor |
| Comparative Example 8 | 8 | O | 200 | poor |

As mentioned above, the resin composition for the electrophotographic toner of this invention contains a low molecular weight olefin polymer dispersed in a vinyl polymer. In the course of dispersion, the resin is subjected to foaming as a result of solvent evaporation accompanied by pressure variation. By utilizing this phenomenon, the low molecular weight olefin polymer can be finely and uniformly dispersed in the vinyl polymer without affecting upon toner properties such harmful effect as the deterioration of the resin due to long residence time at high temperatures. Therefore the present invention is very excellent.

In addition, the toner prepared from the resin compositions of this invention is excellent in the offset preventing property as well as remarkably improved in the dispersed state of colorants and charge control agents. Therefore the toner is very excellent in adapting to high-technology and quick-operation of the electrophotograph.

What is claimed is:

1. A resin composition for a heat-fixing electrophotographic toner obtained by providing a 50–90 wt./wt. % organic solvent solution containing 100 parts by weight of a vinyl polymer, mixing thereto 0.01–15 parts by weight of an olefin polymer having a number average molecular weight of 1,000 –50,000, and removing the solvent from the resulting mixture at 120°–250° C. and under an absolute pressure of 0 –200 mmHg.

2. The resin composition as claimed in claim 1 wherein the organic solvent solution of the vinyl polymer has a concentration of 30 –70 wt. %.

3. The resin composition as claimed in claim 1 wherein the organic solvent is an aromatic compound, a ketone or an ester.

4. The resin composition as claimed in claim 1 wherein the solvent removal is carried out at a temperature of 150°–220° C.

5. The resin composition as claimed in claim 1 wherein the solvent removal is conducted by flashing the resulting mixture into a vacuum system.

6. The resin composition as claimed in claim 5 wherein the vacuum system is evacuated to a vacuum of 0–50 mmHg.

7. The resin composition as claimed in claim 1 wherein the organic solvent solution is obtained by subjecting a vinyl monomer to a solution polymerization, a bulk polymerization, a suspension polymerization or a combination thereof.

8. An electrophotographic toner containing a proportion of 30–95 parts by weight of the resin composition claimed in claim 1 and 70–5 parts by weight of a pigment or a magnetic material.

9. A method for the preparation of a resin composition for electrophotographic toner which comprises providing a 50–90 wt./wt. % organic solvent solution containing 100 parts by weight of a vinyl polymer, mixing thereto 0.01–15 parts by weight of an olefin polymer having a number average molecular weight of 1,000–50,000, and removing the solvent from the resulting mixture at 120°–250° C. and under an absolute pressure of 0–200 mmHg.

10. The method of preparation as claimed in claim 9 wherein the organic solvent solution of the vinyl polymer has a concentration of 30–70 wt. %.

11. The method of preparation as claimed in claim 9 wherein the organic solvent is an aromatic compound, a ketone or an ester.

12. The method of preparation as claimed in claim 9 wherein the solvent removal is carried out at a temperature of 150°–220° C.

13. The method of preparation as claimed in claim 9 wherein the solvent removal is conducted by flashing the resulting mixture into a vacuum system.

14. The method of preparation as claimed in claim 13 wherein the vacuum system is evacuated to a vacuum of 0–50 mmHg.

15. The method of preparation as claimed in claim 9 wherein the organic solvent is obtained by subjecting a vinyl monomer to a solution polymerization, a bulk polymerization, a suspension polymerization or a combination thereof.

16. The method of preparation as claimed in claim 9 wherein the composition contains 30–95 parts by weight of the resin composition and 70–5 parts by weight of a pigment or a magnetic material.

* * * * *